United States Patent [19]

Reichenberger

[11] 4,276,999

[45] Jul. 7, 1981

[54] BEVERAGE DISPENSING SYSTEM

[76] Inventor: Arthur M. Reichenberger, 1916 N. 21st Pl., Phoenix, Ariz. 85006

[21] Appl. No.: 956,439

[22] Filed: Nov. 1, 1978

Related U.S. Application Data

[63] Continuation-in-part of Ser. No. 767,772, Feb. 11, 1977, Pat. No. 4,162,028.

[51] Int. Cl.[3] ..... B67D 5/56

[52] U.S. Cl. ..... 222/129.4; 222/17; 222/47; 222/144.5; 364/479

[58] Field of Search ..... 222/14, 15, 16, 17, 222/20, 21, 22, 23, 31-38, 41, 42, 47, 49, 52, 59, 63, 76, 129.1-129.4, 144.5, 145, 309; 235/92 FL; 364/465, 466, 479, 509, 510

[56] References Cited

U.S. PATENT DOCUMENTS

| | | | |
|---|---|---|---|
| 2,631,437 | 3/1953 | Bruce et al. | 222/16 |
| 3,428,218 | 2/1969 | Coja | 222/23 |
| 3,524,067 | 8/1970 | West | 250/231 R X |
| 3,756,456 | 9/1973 | Georgi | 222/14 X |
| 3,785,526 | 1/1974 | Shinn | 222/14 |
| 3,809,866 | 5/1974 | Scoville | 235/92 FL X |
| 3,825,153 | 7/1974 | Patrick et al. | 235/92 FL X |
| 3,830,405 | 8/1974 | Jaeger | 222/129.3 |
| 4,136,708 | 1/1979 | Cosentino et al. | 222/47 X |

*Primary Examiner*—Robert J. Spar
*Assistant Examiner*—Edward M. Wacyra

[57] ABSTRACT

A beverage dispensing system which lessens confusion and operator time by providing a control switchset with only a small number of selection switches to send encoded signals to an electronic control which decodes the selection data and selects ingredients to be dispensed from more numerous types of ingredients stored remotely. An electronic control regulates the volume dispensed by counting electronic volume related signals sent from each liquid delivery pump shaft as ingredients are dispensed, and stopping that particular delivery pump when a predetermined number of signals have been delivered. Switches are provided to electronically alter the number of counts necessary to stop the delivery pump for one ingredient for one dispensing cycle or for all ingredients for a period of time. The electronic control is capable of storing a first ingredient selection and simultaneously by dispensing a plurality of ingredients upon receiving a second selection.

4 Claims, 5 Drawing Figures

134
130
132N
138
140N
24

145
147N
155
157N
142
144
136
32
34N
48
100

44
146
150
40
80
152
160
154
24
26N
156
162
58
81
52
158
54
85
56

BEVERAGE DISPENSING SYSTEM

CROSS REFERENCE TO RELATED APPLICATION

This is a continuation-in-part application of my prior filed co-pending application Ser. No. 767,772, filed Feb. 11, 1977, and entitled "BEVERAGE DISPENSER", now U.S. Pat. No. 4,162,028.

BACKGROUND OF THE INVENTION

Beverage dispensing systems such as the post-mix soda gun have been popular for at least twenty years and are now utilized in approximately 90% of the bars and cocktail lounges in this country. They consist of a dispenser handset with selection switches coupled with an under bar group of solenoid valves controlling pressurized syrup ingredients and carbonated water. Actuation of a selection switch opens a syrup valve and a carbonated water valve so the ingredients can flow to a mixing chamber in the handset through flexible delivery conduits before being dispensed.

Early liquor systems have utilized the same techniques with timer controlled solenoid valves regulating the flow of pressurized liquor. These systems were not successful sales wise, because the measured quantity was not consistant due to pressure variations, timer variations, and kinks in the delivery conduits. These slight variations are not readily noticeable when the end product such as cola is a mixture of ingredients, but when a one ounce shot of liquor is called for at over $100.00 a gallon, it must be exactly one ounce.

More recent liquor systems have utilized positive displacement pumps for exact measurement but they have suffered from the difficulty of changing the volume of the drink delivered. If the drink recipe called for a half measure or a half measure more there was no simple method of changing the volume delivered for that one drink or for a period of time such as a happy hour.

Previous attempts to control the volume dispensed include: U.S. Pat. No. 3,598,287 showing a knobwheel cooperating with a limit switch which must be adjusted manually. U.S. Pat. No. 3,830,405 shows an adjusting handle with threads to screw inwardly in order to limit the retracting movement of the piston. U.S. Pat. No. 3,785,526 shows a manually adjustable servo switch operated by a rack and pinion gear attached to the piston rod. The intent of the required manual adjustment was to insure the accuracy of each pump not to change the volume to be delivered by one pump for one dispensing cycle. It can also be appreciated that it would be impractical on a system involving 24 pumps to adjust all 24 pumps for the duration of a happy hour.

U.S. Pat. No. 3,830,405 shows a dispenser handset with both liquor and soda mix selection buttons but it is obvious that as the number of selections are increased the more confusing the selection becomes and the more chance there is for operator error.

SUMMARY OF THE INVENTION

The present invention comprises a novel combination of a dispensing fixture, a group of control switches capable of sending encoded signals to an electronic control system, a liquid delivery means for each ingredient with a flow sensing or volume related signal generating switch giving input to the electronic control system. The control system decodes the encoded signals from the control switches, starts the selected delivery means through a dispensing cycle and stops the delivery means upon receiving a predetermined number of signals from the respective signal generator, thus completing the dispensing cycle. The electronic control system can be adjusted electronically to change the predetermined number of signals necessary to stop the delivery means for one dispensing cycle or for a period of time.

Accordingly, it is an object of the present invention to prevent confusion and mistakes by providing a dispenser handset with a limited number of control switches sending encoded signals to select a larger number of ingredients to be dispensed.

Another object of the invention is to provide an electronic means of changing, for one dispensing cycle, the predetermined quantity of liquor to be dispensed from a selected positive displacement pump.

Another object of the invention is to control the simultaneous dispensing of a plurality of ingredients according to a predetermined ratio.

Another object of the invention is to provide a dispensing handset which separates the syrup and soda ingredients from the liquor ingredients to prevent the possibility of the carry over of a taste from the residual of one or the other.

Further objects and advantages of the invention may be apparent from the following specifications, appended claims and accompanying drawings.

DESCRIPTION OF THE PREFERRED EMBODIMENTS

Figure 1:
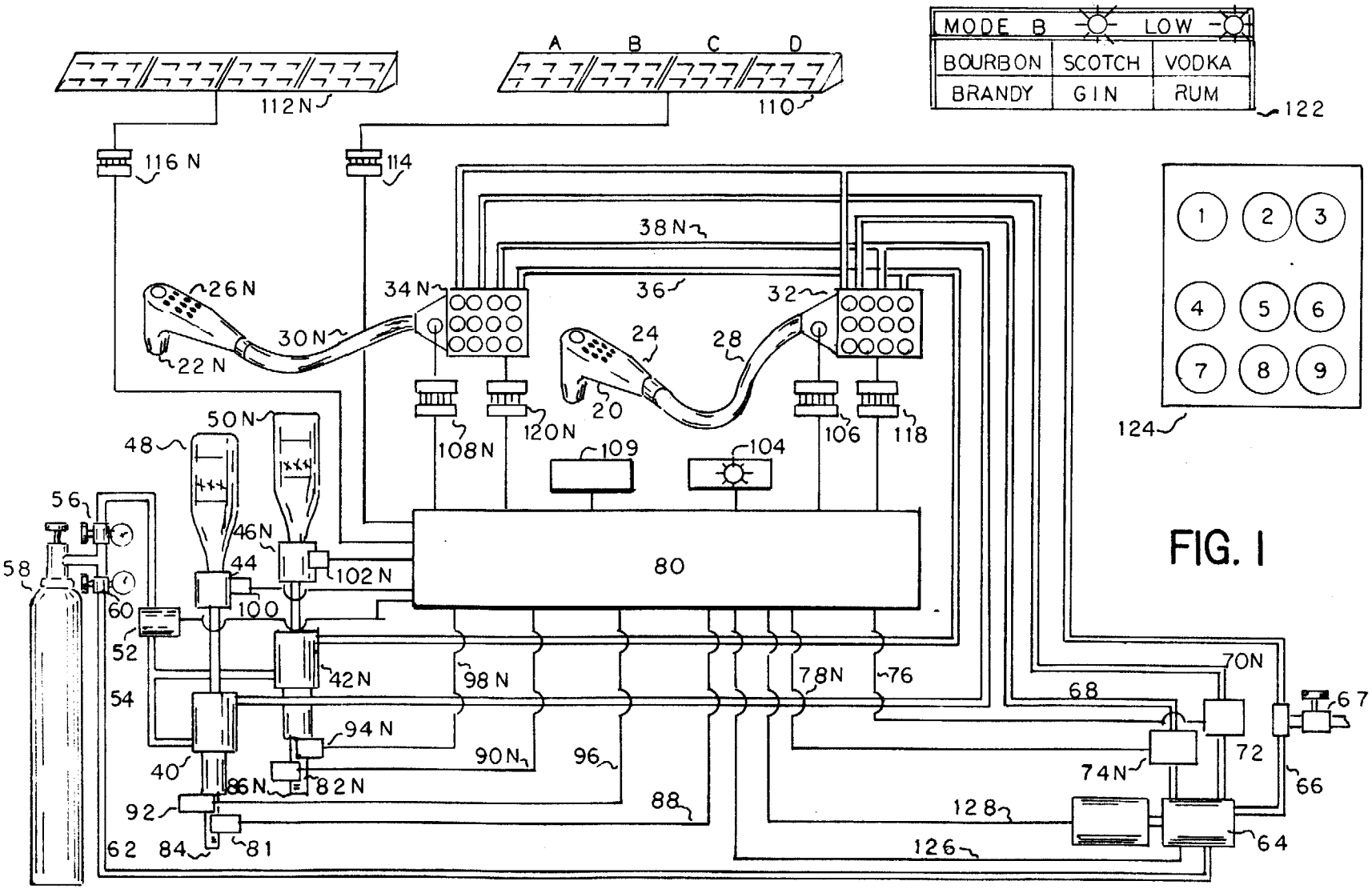
FIG. 1 is a block diagram with partial perspective parts illustrating a beverage dispensing system with multiple serving stations each with dispenser handsets coupled with a common ingredient supply and electronic control.

Reference is hereby made to FIG. 1 which generally illustrates a complete two or more station beverage system with common liquor supply carbonator and pumps.

Among the principle elements are dispenser handsets 20 and 22N with electronic control switches 24 and 26N, flexible ingredient delivery conduits 28 and 30N, ingredient solenoid valves 32 and 34N, ingredient delivery conduits 36 and 38N coupled with positive displacement pumps 40 and 42N, and ingredient supply receptacles 44 and 46N into which ingredient, either liquor or syrup, bottles 48 and 50N are inverted. Three way air solenoid valve 52 is coupled with pumps 40 and 42N through air manifold 54 to power the displacement piston in each pump. Regulator 56 controls the pressure from $CO_2$ bottle 58. A second regulator 60 and air line 62 supplies carbonator 64. Water line 66 supplies carbonator 64 from tap 67. Conduits 68 and 70N deliver carbonated water to respective ones of ingredient control valves 32 and 34N. Water line 66 also supplies ingredient control valves 32 and 34N. Signal generating flow sensing devices 72 and 74N send signals through lines 76 and 78N to electronic control 80. Signal generating opto-electronic switches 81 and 82N read increments of cards 84 and 86N which are attached to the piston rod, described in more detail in FIG. 3, and send volume related signals to electronic control 80 via lines 88 and 90N. Opto-electronic switches 92 and 94N read cards 84 and 86N and send signals via lines 96 and 98N to electronic control 80 to indicate a ready to dispense condition. It is to be understood that while an opto-electronic card reader is preferred, the same signals could be generated by a mechanical switch actuated by cam-like protrusions on the pump shaft or by Hall effect switches actuated by magnets on the pump shaft.

Level sensing devices 100 and 102N are coupled in circuit with electronic control 80 to signal shutdown or alarm if supplies are inadequate. A hexidecimal thumbwheel or digital switch 104 signals electronic control 80 to determine the base count number of signals to be received from signal generators 81 and 82N before electronic control 80 de-energizes the respective ones of ingredient solenoid valves 32 and 34N to stop dispensing.

Electronic control switches 24 and 26N are coupled by connectors 106 and 108N to electronic control 80 to deliver encoded signals pertaining to selection, drink volume, readout, etc. Three way air solenoid valve 52 is controlled by electronic control 80 to drive all pumps when one of liquid ingredient valves 32 or 34N is actuated. It should be understood that several ingredient solenoid valves from group 32 and 34N may be energized and opened at different times while air solenoid valve 52 is open and also they may be closed independently while air solenoid valve 52 is opened. Thus the driving force would be applied to all pump pistons when one ingredient valve is opened but only one pump will displace liquid ingredients when that beverage solenoid valve is open.

Readout 109 displays data contained by electronic control 80 upon receiving certain encoded signals from control switches 24 and 26N. It is to be understood, however, that this readout could take the form of a cash register, printer or a simple digital counter.

Panels 110 and 112N list the selectable ingredients in mode groups A, B, C and D, a typical one of which is illustrated at 122, and have illuminating means which are coupled in circuit with electronic control 80 by couplers 114 and 116N. Any mode group of ingredients such as 122 will be illuminated according to the encoded signals received by electronic control 80 from switches 24 or 26N. A typical switch set 124 is enlarged to illustrate how actuation of encoded switches 1, 2 or 3 would cause electronic control 80 to illuminate one of three alternate mode groups such as illustrated at 122. Subsequent actuation of switches 4 through 9 would cause electronic control 80 to select one of the ingredients from the selected alternate mode group. For example, if switch 1 were actuated to select an alternate mode group such as B 122, then the subsequent actuation of switch 5 would select scotch since scotch is in the same location on the mode group panel B 122 as switch 5 is on the switch set 124. It is to be understood that selections 4–9 would deliver six ingredients and that switches 1 plus 4–9 would deliver an alternate six selections and that switches 2 plus 4–9 would deliver another six ingredients and so forth. The numeric codes could vary utilizing six switches with switches 3–6 delivering four selections and switches 1 plus 3–6 delivering an alternate four selections and 2 plus 3–6 would deliver another four selections.

Drivers in electronic control 80 start and stop carbonator 64 via line 128 according to signals received from carbonator 64 via line 126.

Figures 2, 3:
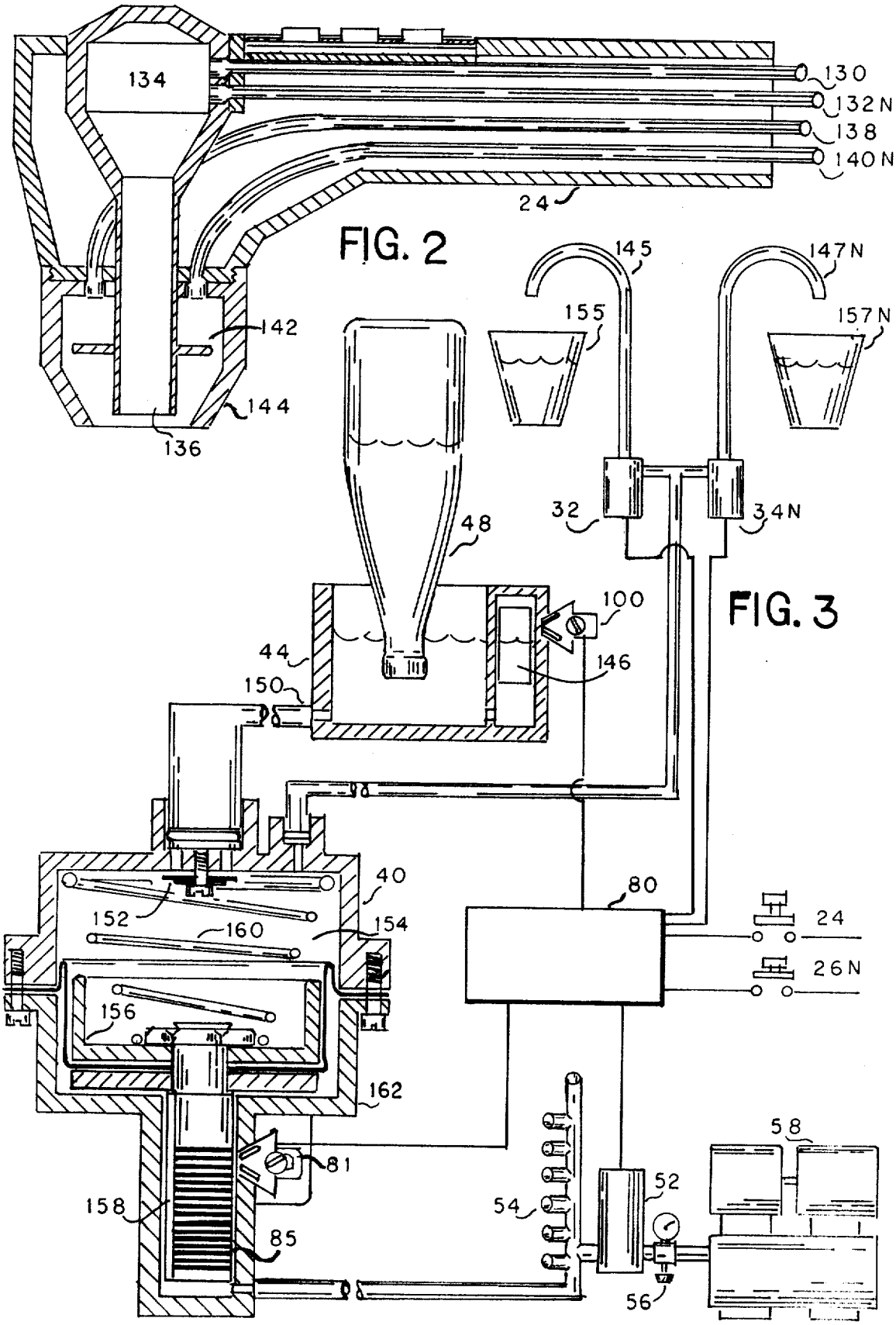
FIG. 2 is a fragmentary cross-sectional view of a typical dispenser handset showing a separate mixing chamber for syrup and soda isolated from the discharge of liquor ingredients.
FIG. 3 is a cross-sectional view of a typical positive displacement pump with signal generating opto-electronic switches.

Reference is made to FIG. 2 which is a cross-sectional view of a typical dispenser handset 20. Syrup and carbonated water delivery conduits 130 and 132N discharge into mixing chamber 134. The mixed ingredients flow with gravity through passage way 136 directly into a beverage glass. Liquor delivery conduits 138 and 140N discharge their ingredients against baffle 142 to prevent the high pressure stream of liquor from squirting directly into the glass where it might splash out on the bar. After being baffled, the ingredients are directed into the glass by discharge nozzle 144 without coming into contact with the syrup ingredients in passage way 136.

Reference is hereby made to FIG. 3 which is an enlarged elevation and sectional view of a typical liquid delivery means which comprises the elements necessary to make it functional, including: liquor or syrup bottle 48 inverted into ingredient supply receptacle 44, opto-electronic level sensing device 100, a rolling diaphragm air or gas driven positive displacement pump 40, ingredient solenoid valves of groups 32 or 34N, fixed or moveable dispenser spouts 145, or 147N, electronic control 80, air or gas supply 58, regulator 56, three-way air solenoid valve 52, pressurized air or gas manifold 54, control switches of switch sets 24 and 26N, opto-electronic volume increment reading generator 81, and reflective and non-reflective increments 85, on piston rod 158.

Float 146 raises or lowers according to the ingredient level of receptacle 44; opto-electronic switch 100 senses the absence of float 146, if level is low, and signals electronic control 80 to shut down the system, sound an alarm, or turn on a warning light. Ingredient supply line 150 is coupled with pump 40 to deliver ingredients past check valve 152 to fill chamber 154. Electronic control 80 energizes an ingredient solenoid valve of group 32 or 34N upon receiving signals from switches of switch groups 24 and 26N. Electronic control 80 also energizes three-way air solenoid valve 52 anytime any ingredient solenoid valve from groups 32 or 34N is energized. Pressurized air or gas from supply 58 is allowed to enter the bottom side of all pistons 156 by a single air solenoid valve 52, and manifold 54 driving the piston 156 and displacing liquid ingredients in chamber 154 through the open valve from groups 32 or 34N into dispenser nozzle 145 or 147N where it drops into the serving glass 155 or 157N. While all pistons are pressurized anytime one ingredient is selected, the only time the piston moves is when that particular ingredient is called for and then it will dispense only from the particular valve from a certain one of up to four dispenser stations from which it is designated.

Piston rod 158 having alternately spaced reflective and non-reflective increments moves with piston 156 as ingredients are dispensed. The opto-electronic switch 81, such as but not limited to Optron's OPB 125 A, generates a volume related signal with the passing of each increment 85 of rod 158. These signals are counted in the electronic control 80 and compared with a preset number. When this preset number is reached an ingredient solenoid valve of group 32 or 34N is de-energized halting the flow of ingredients. If another ingredient valve of groups 32 and 34N is not open and not dispensing simultaneously three-way air solenoid valve 52 is de-energized allowing the pressure on the bottom side of piston 156 and all other pistons to escape to atmosphere so spring 160 can return piston 156 to the retracted position of the pump housing 162. While the electronic control 80 would normally wait for the pump to return to the fully retracted position, it could dispense a second portion without retracting since the volume is measured by the number of signals received not the starting position of the pump. FIG. 1 shows switch 92 which indicates when there is not adequate stroke left to deliver a full measure. Switch 92 is not needed in a microprocessor controlled system described later since the number of signals received can be put in memory by proper softwave program so that the pump will not start a cycle after a certain number of signals have been received.

Figure 4:
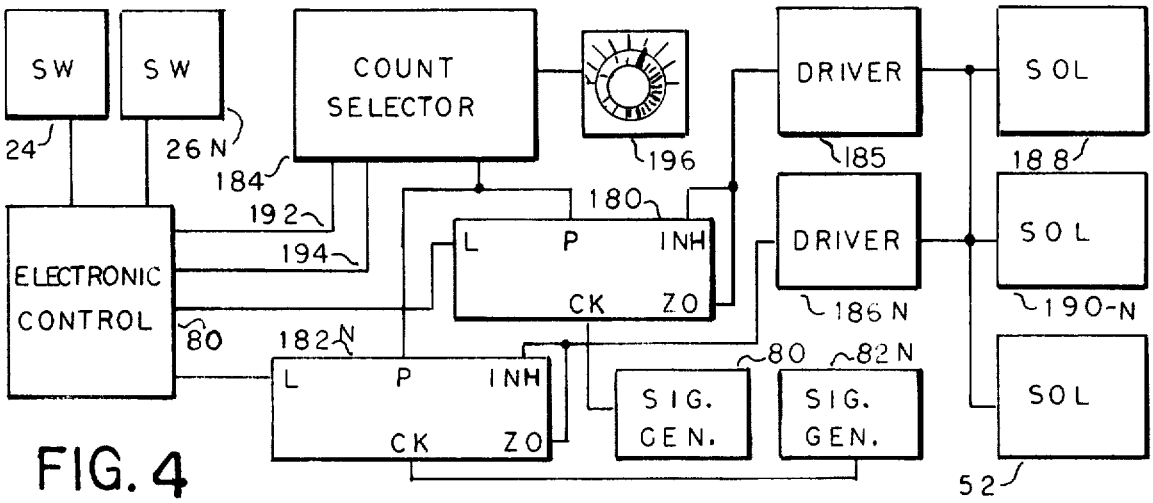
FIG. 4 is a block diagram of that portion of the electronic control which starts and stops beverage solenoid valves for dispensing predetermined quantities, and means for altering these quantities.

Reference is hereby made to FIG. 4 of the drawings which is a block diagram of that portion of the electronic control 80 where discrete electronics or integrated circuits are used to control the selection and delivery pumps as described in my related now issued U.S. Pat. No. 4,162,028. While the selection control is described in detail in FIG. 4 of my related now issued U.S. Pat. No. 4,162,028, each ingredient solenoid would require this separate control if simultaneous dispensing were desired from alternate handsets.

A selection from switch set 24 or 26N will give an output signal from selection control 80 which is coupled at junction (L) of down counters 180 and 182N, a presetable binary counting device such as, but not limited to, Motorola's MC 4019313 or RCA's CD 40193B. This will cause the down counter to go to a value equal to the binary number output from counter selector 184.

Clock output (CK) of down counters 180 and 182N is connected to volume related signal generators 81 and 82N. The zero out (ZO) lines of down counters 180 and 182N enable solenoid drivers 185 and 186N to energize beverage solenoids 188 and 190N controlling the flow of beverage ingredients. Each signal received by a down counter 180 or 182N from generators 82 or 82N causes it to count down to zero. When zero is reached, drivers 184 or 186N de-energize beverage solenoids 188 or 190N. The zero output stays at zero because it is connected to the inhibit (INH) terminal. Air solenoid valve 52 is coupled with all beverage drivers 184 and 186N so that it is energized each time any beverage solenoid is energized.

Electronic control 80, when signalled to deliver a short pour or long pour from switches of 24–26N, will provide output to lines 192 or 194 to cause count selector 184 to switch to one of two alternate numbers changing the present number so that the down counters 180 and 182N would count down from an altered number either higher or lower for one dispensing cycle, thus increasing or decreasing the volume dispensed.

A hexidecimal thumb-wheel switch 196 gives an output to count selector 184 to change the preset number the down counters 180 and 182N will go to and cause the volume delivered to be altered. This adjustment would be done by management during happy hours or private parties.

Figure 5:
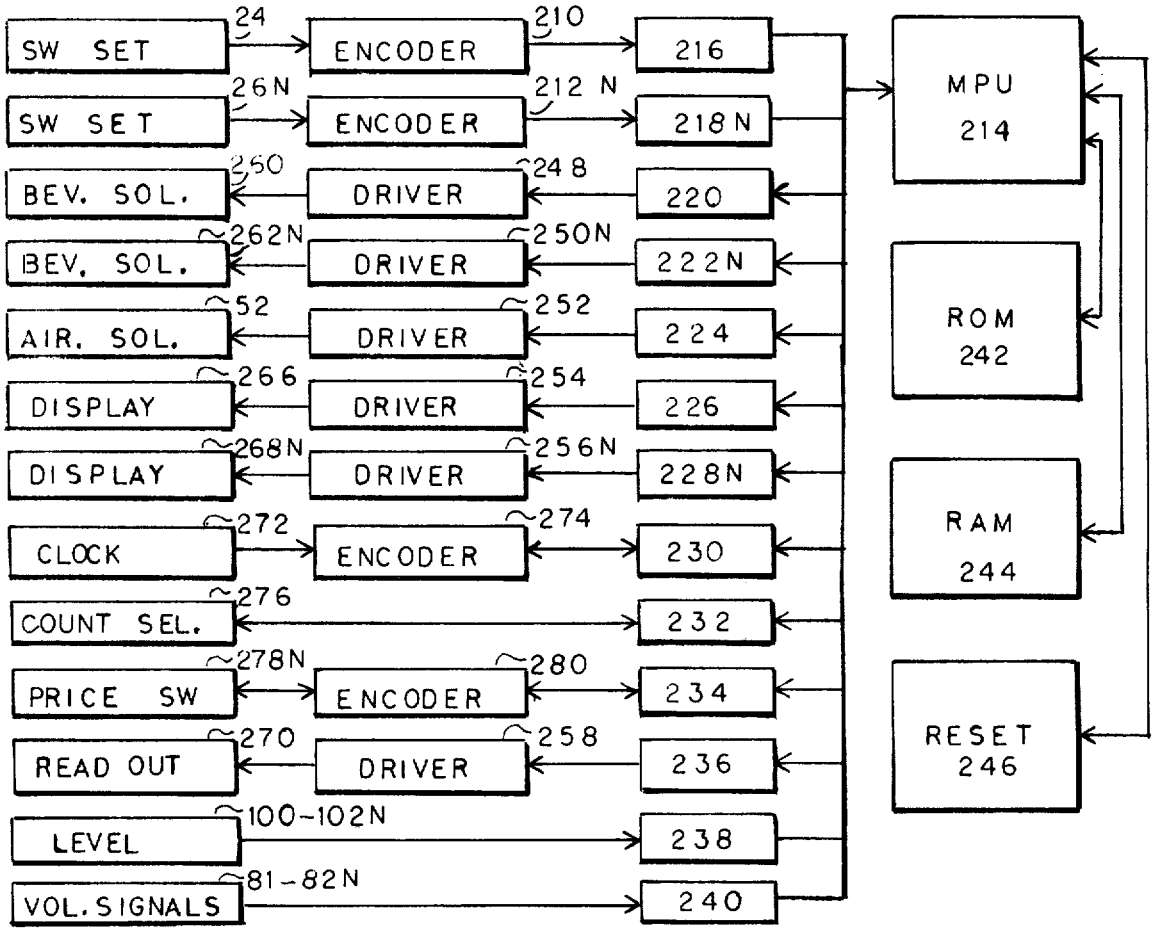
FIG. 5 is a block diagram of a microprocessor based electronic control for multiple station systems utilizing common supplies and delivery pumps.

Reference is hereby made to FIG. 5 of the drawings which is a block diagram of a microprocessor based electronic control combining the functions described in FIG. 4 and the discrete electronic elements in FIG. 4 of my related now issued U.S. Pat. No. 4,162,028.

A general purpose programable digital microprocessor 214, such as, but not limited to, Motorola's MPU 6800 or RCA's CPU 1800, may be utilized or a special purpose microprocessor may also be utilized if desired.

Encoders 210 and 212N, such as but not limited to Motorola's 74147 or 74148, convert signals from switches 24, and 26N, to data compatible with Interface adaptors 216 and 218N.

Interface adaptors such as, but not limited to Motorola's 6522 or 6821, receive data and translate it to levels compatible with microprocessor 214, placing the data on the data buss, represented here as a single line for simplicity, upon the request of the processor.

Read only memory 242, such as, but not limited to Motorola's MCM 68A30, directs microprocessor 214 to act upon the data received from the interface adaptor according to the algorithms permanently stored therein.

Random access memory 244, such as but not limited to Motorola's MCM 6810, is a read/write integrated circuit for storage of temporary data for use by microprocessor 214.

Power-up reset 246 is a circuit which sets the microprocessor 214 to known conditions upon power turn-on.

Drivers 248–258 such as Texas Instruments T1-75451 are logic level conversion circuits which increase power level of control signals to power peripheral devices such as beverage solenoids 260 and 262N, air solenoid 52, display panel lights 266 and 268N and readout display 270 which could take the form of a printer or cash register.

Time of day clock 272 such as but not limited to Motorola's MM 5312, inputs data through encoder 274 and interface adaptor 230 to alter the volume of drinks for periods of time such as happy hours as management requests.

Count selector switch 276 inputs encoded data through interface adaptor 232 to manually alter the volume of drinks. A hexidecimal knob wheel switch may be utilized to select the base number of counts necessary to de-energize the beverage solenoids 260 and 262N.

Encoded signals from control switches 24 and 26N can alter for one dispensing cycle the number of counts necessary to de-energize one of beverage solenoids of 260 and 262N.

Price switches 278N provide microprocessor 214 through encoder 280 and interface adaptor 234 data necessary to extend the price of various drinks dispensed during various time periods where cash register type readouts are desired. Clock 272 can alter these prices for periods of time such as happy hours.

Level sensors 100–102N provide microprocessor 214 data through interface adaptor 238 to energize warning light on display 266 and 268N.

Opto-electronic switch 81 reads volume related segments 85 on pump shaft 158, of FIG. 3, generating signals which provide microprocessor 214, now viewed in FIG. 5, through interface adaptor 240, data representing a numerical count to be compared with the number in count selector switch 276 to de-energize the respective beverage solenoid of 260 and 262N.

A typical dispensing cycle would involve the following: In FIG. 1, an enlargement of switch sets 24 and 26N is shown at 124. A signal from control switch 1 is changed to a compatible logic level by encoder 210 and sent to microprocessor 214 through interface adaptor 216 where the data is processed under the permanent program stored in read only memory 242.

The microprocessor 214 under control of read only memory 242, will identify the dispenser handset, read supply level switches 100–102N and read pump status data stored in random access memory 244 to see if adequate stroke is left to dispense a full drink or if pump is busy and enable driver 254, through interface adaptor 226 to energize display lamp 266 shown in FIG. 1 as mode B at 110 and in detail at 122. Microprocessor 214 having been placed in mode B will only receive selections of brands listed at 122 from control switches 4–9 at 124 of FIG. 1.

A signal from control switch 5, as shown in FIG. 1, is changed to compatable logic by encoder 210 and sent to microprocessor 214 through interface adaptor 216.

Microprocessor 214, under program control from read only memory 242, will activate solenoid driver from 248–250N via interface 220–222N and open beverage solenoid from 260–262N, corresponding with scotch, also activate air solenoid driver 252 via interface 224 to open air solenoid valve 52 powering all pumps. The piston rod of the pump containing scotch from mode group B of FIG. 1 will move reflective and non-reflective segments 85 past opto-electronic signal generator 81, as seen in FIG. 3, generating one signal for each increment of movement as the piston 156 of FIG. 3 delivers scotch through solenoid valve from 260–262N previously opened. These signals are received via interface 240, FIG. 5, by microprocessor 214 where they are counted and compared with a count predetermined by count selector 276, via interface 232.

When the predetermined count is reached, microprocessor 214 signals the previously selected beverage solenoid from group 248–250N via interface 220–222N to de-energize its beverage solenoid valve and stop the flow.

Microprocessor 214 also signals driver from group 254–256N via interface 226–228N to de-energize mode B display lamp and energize mode A lamp as seen in FIG. 1 at 110, since it is programmed by read only memory 242 to return to its normal mode A upon the completion of any dispensing cycle. It will be noted that any actuation of switches 4–9 not preceded by the actuation of switch 1, as seen in FIG. 1, will cause the dispensing of selections from mode A.

To avoid confusion, the typical dispensing cycle mentioned above did not include the provision whereby microprocessor 214 can place the first selection from mode group B in random access memory 244 to be retrieved upon making a second selection from mode group A for simultaneous dispensing of both ingredients.

The preferred embodiment, as illustrated at 124 of FIG. 1 would utilize switch 1 for changing the mode with one actuation for mode B, two actuations for mode C, three actuations for mode D and four actuations to cancel or clear the keyboard. Switch 2 would signal a short pour and switch 3 a long pour for the next cycle. Other options might include switch 1 for mode B, switch 2 for mode C, switch 3 for mode D. Short pour could be signalled by two actuations of the same selector switch from 4–9. Long pour could be signalled by holding the switch closed until the completion of the normal cycle. Other combinations might be employed to get the same results.

Actuation of the short pour or long pour switches from switch sets 24–26N will signal the microprocessor 214 to an alternate program for one dispensing cycle which would add to or subtract from the base number of count selector 276. Depending on the program, this can be handled by either read only memory 242 or random access memory 244.

Optionally, the microprocessor 214 can determine the drink price by reading price switches prior to energizing the beverage solenoids for direct cash register interface or store this data in random access memory 244 for later readout.

Optionally, the microprocessor 214 can be programmed to modify the price structure at various times of the day, for example, during happy hour or when there is an entertainment tax. This can be directed by the clock 272.

Optional data can be generated under program control to keep an inventory by brand and print an open-to-buy purchase order. Percentage cost ratios can be generated for each station to compare the performance of various bartenders.

Through interrupt program sequencing, the microprocessor is able to control many beverage solenoids simultaneously dispensing from several stations with only one set of ingredient supplies.

It will be understood that various modifications of the electronics or disclosed structure will occur to those skilled in the art and it is intended that the invention be limited only in accordance with the appended claims.

What is claimed is:

1. A beverage dispenser comprising:

(a) a dispenser handset;

(b) a plurality of liquid delivery conduits coupled to said dispenser handset for delivering liquid beverage ingredients thereto;

(c) a plurality of liquid delivery means, each coupled respectively to said delivery conduits;

(d) a plurality of liquid ingredient supplies, each coupled respectively with one of said delivery means;

(e) a plurality of electronic selection switches on said dispenser handset for sending electronic signals when actuated;

(f) a plurality of electronic signal generating means, each cooperating with one of said plurality of delivery means for generating volume related signals;

(g) an electronic control means coupled in circuit with said plurality of selection switches, said plurality of delivery means and said plurality of signal generating means and including driving means for energizing selected ones of said plurality of delivery means upon receiving an electronic signal from any of said plurality of selection switches; and (h) stopping means for de-energizing said selected ones of said plurality of delivery means upon counting a preset number of said volume related signals from the respective said signal generating means.

2. The beverage dispenser of claim 1, wherein said dispenser handset further includes a control switch coupled in circuit with said electronic control means; and said electronic control means further includes count altering means for changing said preset number of volume related signals necessary to be counted from said plurality of signal generating means for actuating said stopping means.

3. The beverage dispenser of claim 1, further including:

(a) a display board listing said beverage ingredients in discrete mode groups;

(b) illuminating means for indicating each of said mode groups, and coupled in circuit with said electronic control means; and (c) energizing means for illuminating selected ones of said mode groups in response to actuation of selected combinations of said selection switches.

4. The beverage dispenser of claim 1 wherein each of said plurality of said liquid delivery means includes:

(a) a pump having a housing with a liquid containing chamber communicating with a respective one of said plurality of delivery conduits;

(b) a piston slidably disposed within said chamber for reciprocal movement;

(c) a rod coupled with said piston;

(d) means for moving said piston and said rod for displacing said liquid from said chamber into said conduit;

(e) a plurality of detectable increments spaced along said piston rod; and (f) stationary detector means for detecting said increments as said piston rod moves relative to said detector means and for sending one of said volume related signals to said stopping means in response to each of said increments.

* * * * *